United States Patent [19]

Euchner, Jr.

[11] 3,964,675

[45] June 22, 1976

[54] APPARATUS FOR LIMITING VACUUM AND PRESSURE IN A FURNACE

[76] Inventor: Perry C. Euchner, Jr., 8 Tracy Drive, Huntington, N.Y. 11743

[22] Filed: Oct. 15, 1974

[21] Appl. No.: 514,408

[52] U.S. Cl. ..... 236/15 C; 110/162

[51] Int. Cl.[2] ..... F23N 1/08

[58] Field of Search ..... 236/15 C; 110/162

[56] References Cited

OTHER PUBLICATIONS

EEI Prime Movers Committe Meeting, 4/30/73, Euchner, Jr.

*Primary Examiner*—William E. Wayner

*Attorney, Agent, or Firm*—Brooks Haidt Haffner & Delahunty

[57] ABSTRACT

A furnace system having a combustion chamber, and heat transfer surfaces, forced and induced draft fans for moving gas through the burner, chamber, and heat transfer surfaces, first controls for maintaining predetermined gas flows and furnace pressure or draft dependent upon the desired normal operating conditions, and second controls responsive to the flow of the gas exterior to the chamber, e.g., at the inlet or outlet of the induced draft fan and, if desired, at the outlet of the forced draft fan, for controlling a damper or dampers in the gas path or the speed of the fans so as to limit the vacuum which can be developed in the chamber by the induced draft fan to a value less than the chamber vacuum withstanding design value. Also, if desired, the second controls at the outlet of the forced draft fan can limit pressure which can be developed in the chamber by the forced draft fan to a value less than the chamber pressure withstanding design value.

11 Claims, 12 Drawing Figures

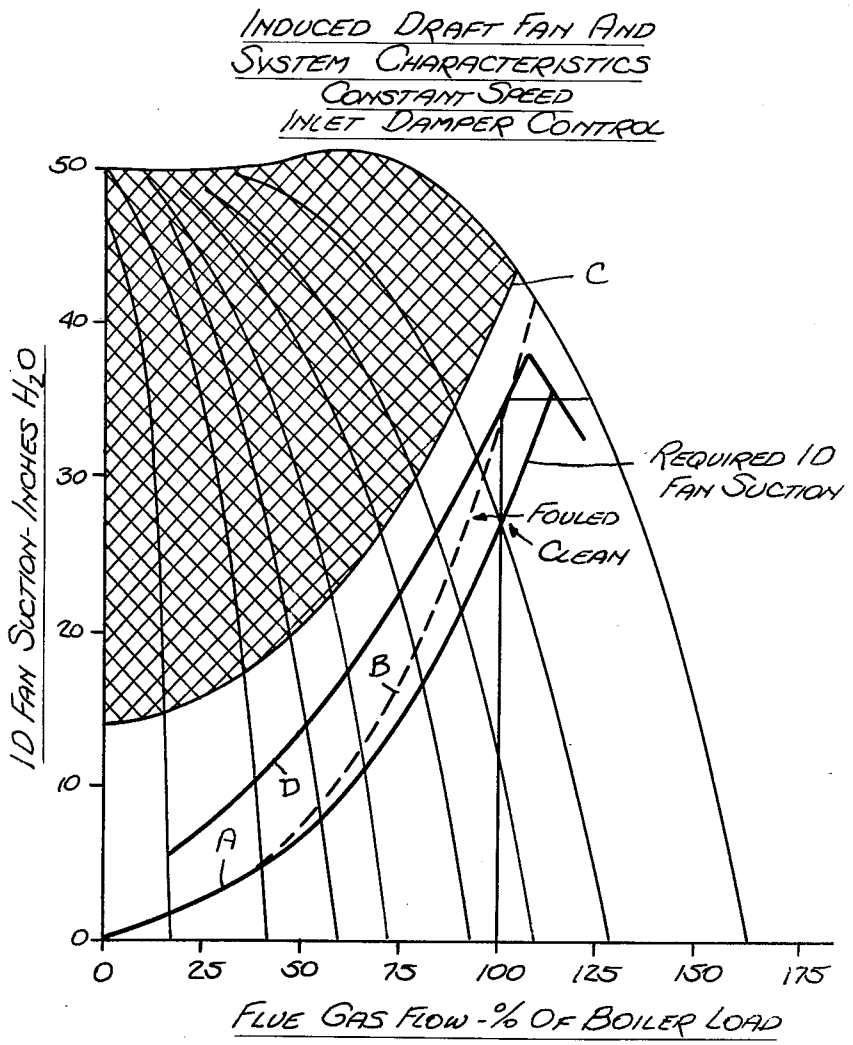
Fig. 2.
Fig. 1. PRIOR ART
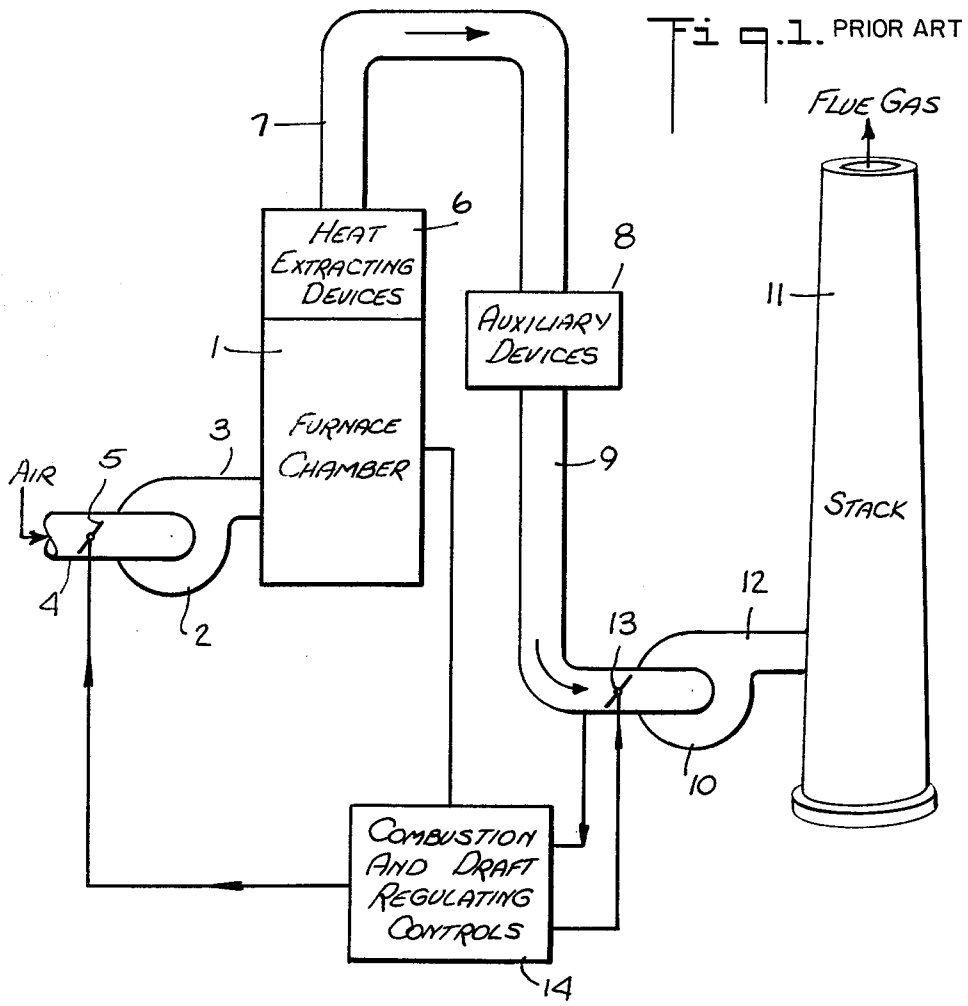

APPARTUS FOR LIMITING VACUUM AND PRESSURE IN A FURNACE

This invention relates to the limiting of the vacuum in a furnace chamber and particularly to the control of the gas removed therefrom so as to prevent damaging vacuum therein.

Furnace structures employed in large steam generating units normally can withstand substantial short-time changes in internal gas pressure but are susceptible to damage when the internal pressure is maintained substantially below atmospheric pressure for a longer period of time. Thus, upon the occurrence of any one of several abnormal conditions, a relatively long lasting, partial vacuum may result in the furnace chamber causing an "implosion" or collapse of the chamber. For example, if there is a malfunction in the draft control system, e.g., opening of the induced draft fan or closing of the forced draft fan or burner dampers in a balanced draft system, a relatively long lasting, partial vacuum may result in the furnace chamber. While such malfunctions, or problems, may occur only infrequently, nevertheless, they can be of sufficient magnitude to damage the furnace, a unit costing a large amount of money.

It is customary in the art to employ fans, known as "forced draft" fans, to supply air to the furnace combustion chamber and in so-called "balanced draft" designs, to use "induced draft fans" to remove combustion gases from the chamber and vent them to a stack. Also, it is customary to provide controls responsive to combustion conditions and other conditions for controlling the flow of the air and other gases in the furnace system and the furnace draft to maintain proper control of combustion. However, such controls attempt to maintain a predetermined set of conditions, and it will be apparent that such controls attempt to maintain such conditions based on measurements at predetermined points in the system regardless of the intermediate conditions or a malfunction in the system. In addition, there sometimes are controls operable when the flame extinguishes (flame out) to vary the draft equipment. Usually, one or both of such controls operate dampers in the gas ducting system and/or control the fans speeds, the term "damper" meaning herein a device, such as a pivotable plate, a plurality of pivotable vanes, etc., in a gas passageway which can be moved so as to vary the effective size of the passageway and thereby modify the gas flow. While such controls may be satisfactory for maintaining proper control of the gas flow in the system under normal conditions, such controls are not satisfactory to prevent furnace damage under abnormal conditions, such as sustained closing of the burner dampers or the forced draft fan inlet damper, e.g., due to sticking or malfunction of a control, while the induced draft fan remains operating or is "coasting down" after it has been de-energized.

From tests conducted on high draft loss boiler systems having forced draft and induced draft fans and conventional draft controls, it has been found that the capacity of the induced draft fan, or fans, is such that if sufficient air is not being supplied to the furnace chamber, e.g., by the forced draft fan, the induced draft fan can create a vacuum in the furnace chamber which applies stresses on the chamber in excess of the chamber design limits. While a short-time, transient stress of such magnitude does not necessarily damage the furnace chamber, experience has indicated that if such stress is maintained for a longer time, the chamber may collapse.

Flame out tests, referred to hereinafter, have also shown that when there is a substantial change in pressure in the furnace chamber, there also is a substantial change in gas flow rate, which accompanies the chamber pressure change, at the input to the chamber and in the flue gas system which is connected to the output of the chamber. For example, the amount of the air supplied by the forced draft fan increases and the amount of the flue gas decreases.

One object of the invention is to provide overriding controls for a furnace system which are responsive to gas flow rate changes resulting from the occurrence of an abnormal operating condition in the system and which prevent abnormal and potentially damaging pressures in the furnace combustion chamber.

In accordance with the preferred embodiment of the invention, gas in the flue gas portion of the furnace system operates a plate or "flapper" which is mechanically connected to a damper at the input of the induced draft fan to vary the characteristic of the induced draft fan so that the vacuum in the furnace chamber is maintained less than predetermined amounts, dependent upon the furnace operating conditions, such amounts being selected so that the furnace chamber may operate within normal pressure ranges but will not be subjected to damaging pressures. Preferably, the flapper is at the output of the induced draft fan and controls a damper or dampers at the inlet of such induced draft fan, so that the pressure in the furnace chamber does not decrease below a predetermined safe level.

In a further embodiment of the invention, the gas flow between the furnace chamber and a variable speed induced draft fan is used to control the speed of such fan and thereby limit the suction produced by the induced draft fan.

One advantage of the preferred embodiment of the invention is that the controls are all mechanical, and, therefore, are less subject to failure and are simpler than electrical or pneumatic controls.

A further advantage of the invention is that the controls can operate relatively rapidly and thereby reduce in magnitude furnace chamber pressure excursions caused by flame out, which are of short duration, even though such excursions may not cause damage.

Other objects and advantages of the invention will be better understood from the following description of presently preferred embodiments thereof, which description should be considered in conjunction with the accompanying drawings in which:

FIG. 1 is a simplified, schematic diagram of a conventional steam generating furnace system;

FIG. 3 is a graph illustrating the variation during flame out of furnace input air and furnace flue gas flow with variations in the gas pressure within the furnace chamber forming part of the system illustrated in FIG. 1;

FIGS. 6 and 7 are, respectively, front elevation and side elevation views illustrating the application of the controls shown in FIGS. 4 and 5 to a known type of induced draft fan;

FIG. 1 is a simplified, schematic diagram of a balanced draft furnace system of the type frequently used to generate steam for the operation of turbines which drive electricity generators. Although the invention will be described in connection with such a system, it will be apparent to those skilled in the art that the principles of the invention may be applied to other types of furnace systems.

Figure 8:
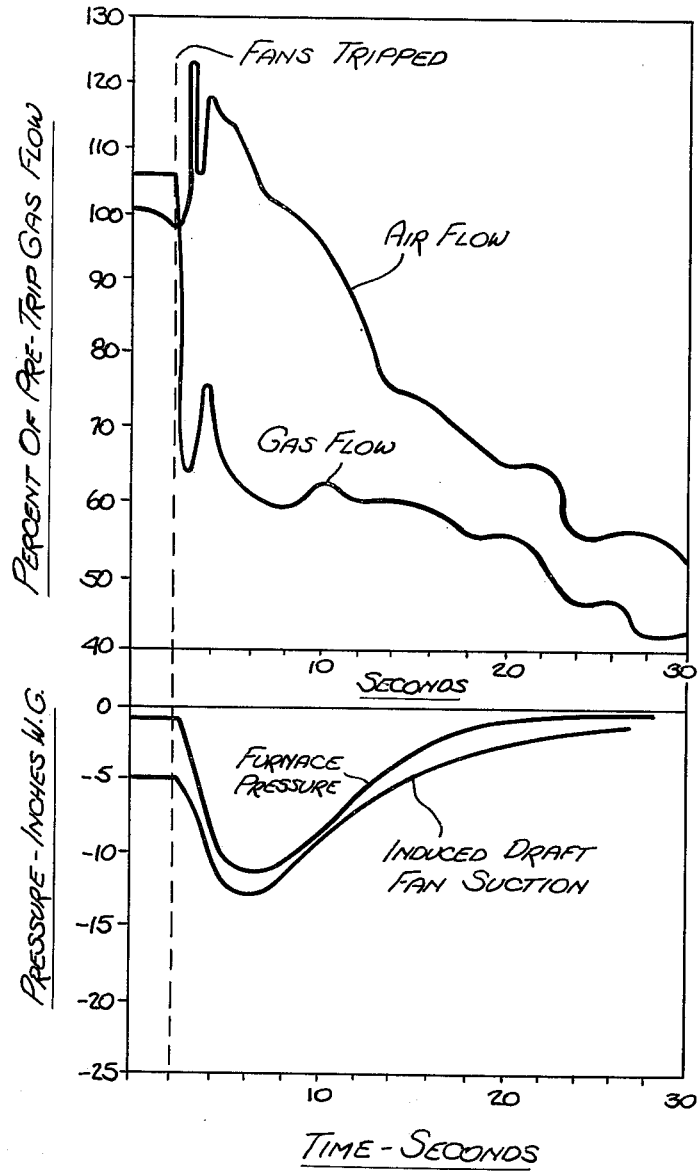
FIG. 8 is a schematic diagram illustrating an alternative embodiment of the invention in which the speed of an induced draft fan is varied for control thereof.

In the system shown in FIG. 1, air is supplied to a furnace combustion chamber 1, having fuel burners therein, by a forced draft fan 2 connected at its outlet to the chamber 1 by a duct 3. As in a conventional system, an air preheater (not shown) may be included in the ducting between the fan 2 and the chamber 1. The inlet of the fan 2 is connected to the atmosphere by a duct 4 having a damper 5 therein for controlling the fan characteristic. The fan 2 may be a variable speed fan or a fan having blades of variable pitch for the purpose of controlling the fan, and in this even the damper 5 may be omitted.

The burners in the chamber 1 may be supplied with fuel in the usual manner, and the chamber may have the conventional air directing and fuel regulating controls and dampers (not shown). Hot combustion gases in the chamber 1 contact the surfaces of heat extracting devices 6, such as water and steam tubes, and the gases, known as flue gases and comprising the combustion products, leave the heat extracting devices 6 and the chamber 1 by way of a duct 7. After leaving the chamber 1, the flue gases usually pass through auxiliary devices 8, such as an economizer, an air preheater, dust collector, etc. From the auxiliary devices 8, the flue gases flow through a duct 9 to the inlet of an induced draft fan 10, the outlet of which is connected to a stack 11 by a duct 12. The operating characteristic of the fan 10 is controlled by a damper 13. If the fan 10 is a variable speed fan or a variable pitch blade fan, the fan may be controlled by varying the fan speed or the blade pitch, and the damper 13 may be omitted.

Combustion and draft regulating controls 14, of a type well-known in the art, control the air and gas flows and furnace draft in the system in response to the conditions existing in various parts of the furnace system. For example, the controls may measure the fuel fired, the air flow or combustion products, and the gas pressures at various points and regulate the dampers 5 and 13 (or the speeds or blade pitch of fans 2 and 10) to obtain the fan settings which have been determined to be most efficient for the operating conditions. Thus, as the furnace or boiler load, i.e., the firing rate, is increased, the amount of air supplied by the fan 2 and the amount of flue gases removed by the fan 10 are increased. Normally, such controls maintain a predetermined air and flue gas flow for each operating condition although it will be apparent that each affects the other. In other words, an increase in the rate at which air is delivered to the furnace 1 will usually increase the flue gas flow rate and vice versa. Similarly, an increase in the flue gas flow rate caused by the induced draft fan 10 will usually increase the air flow rate and vice versa. Accordingly, there are several operating levels of the fans which will produce a predetermined flow of air and gas through the chamber 1, but only one set of levels which will balance furnace draft.

Let is be assumed that because of some malfunction or misadjustment of a control that the controls of the forced draft fan 2 are set below normal. If the controls of the induced draft fan 10 are not similarly and immediately readjusted, the suction produced by the fan 10 will drastically increase. In some installations, the induced draft fan 10 has sufficient capacity to produce a vacuum in the furnace chamber 1 which exceeds the design limits of the chamber 1 if the delivery of air to the chamber 1 is reduced below that which corresponds to that required by the control setting of the induced draft fan 10.

In addition, when the furnace system is being operated manually, such as during start-up or shut-down, the operator may, through inadvertence or misunderstanding, fail to set the forced draft and induced draft controls properly, which again can result in a vacuum in the furnace chamber 1 which exceeds design limits.

Figure 2:
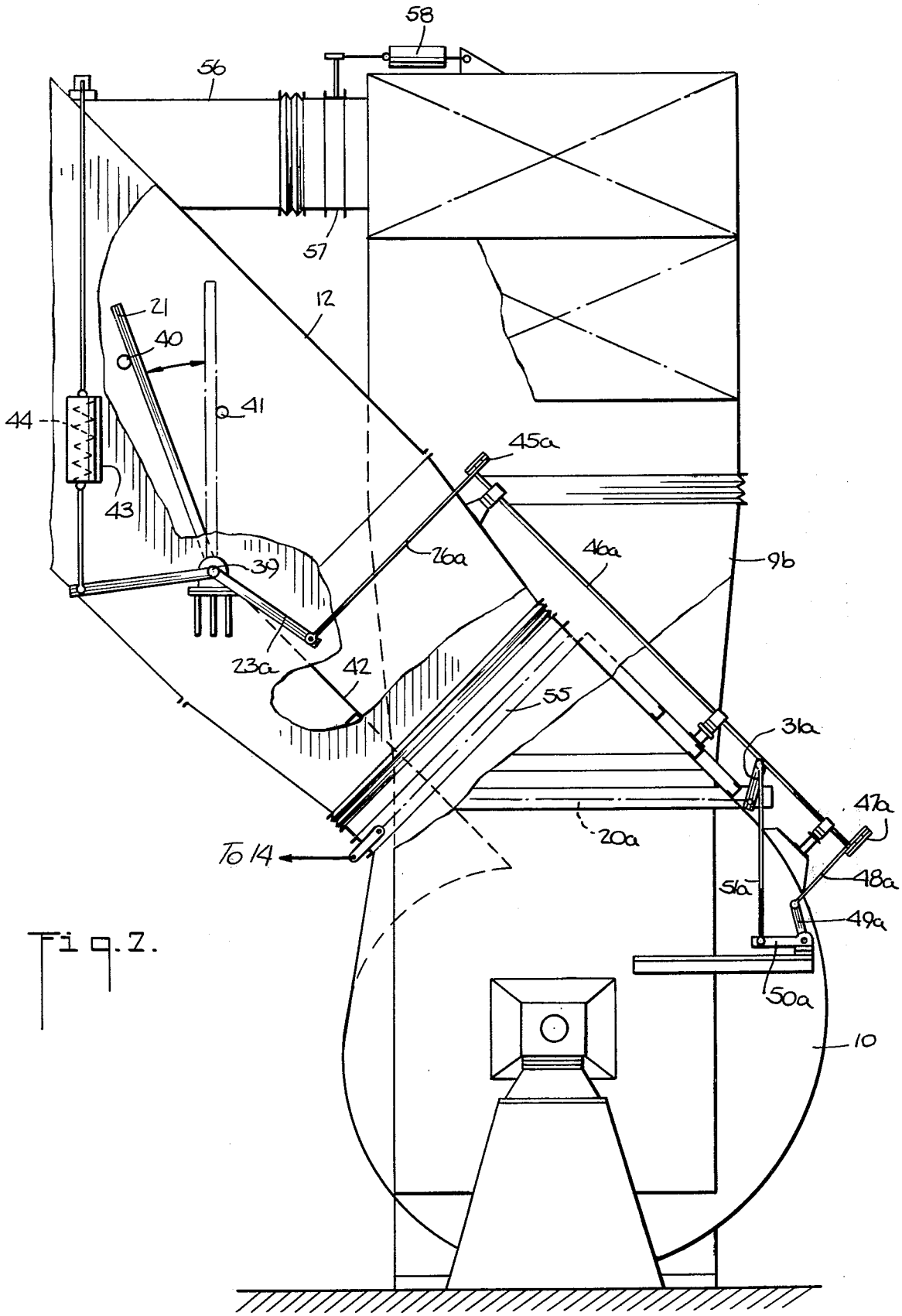
FIG. 2 is a graph used to illustrate the operating characteristics of an induced draft fan employed in the furnace system illustrated in FIG. 1.
Figure 8:
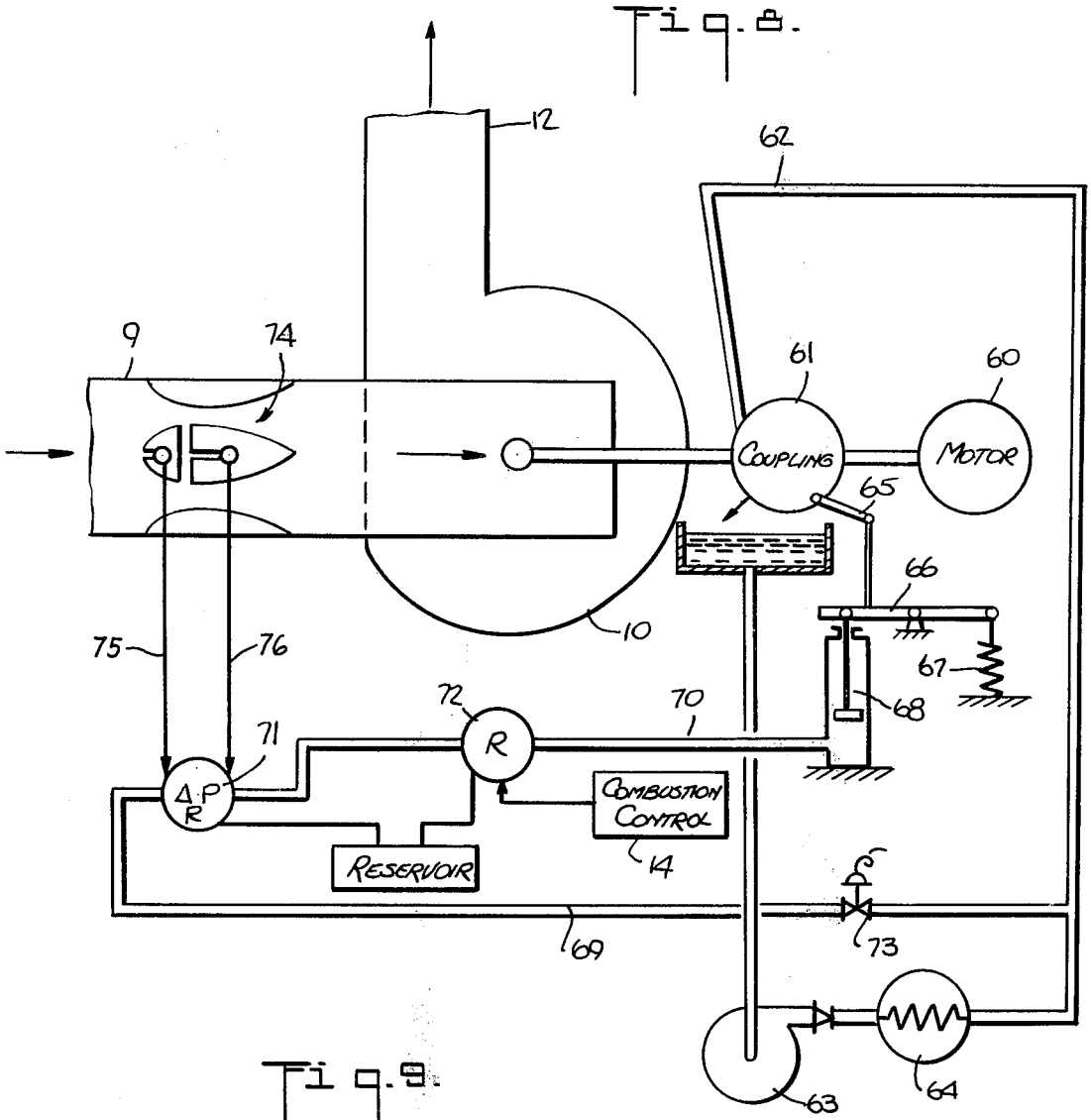

FIG. 2 is a graph illustrating the operating characteristics of a typical constant speed, induced draft fan, such as the fan 10, with an inlet damper, such as the damper 13, for controlling the gas flow through the fan. The generally vertical curves indicate the suction developed upstream of the inlet damper of the fan 10 with various inlet damper 13 settings and with variable amounts of flue gas flow as a percentage of the furnace or boiler load, provided that the downstream resistance may be neglected, the usual case.

Thus, the leftmost curve represents the suction with the inlet damper closed to the extent required to reduce the flue gas flow to about 15% with no gas flow restriction upstream of the inlet damper, and the rightmost curve represents such suction with the inlet damper wide open. It will be noted that if the gas flow upstream of the inlet damper is restricted, the suction increases rapidly for a given damper setting.

Curve A in FIG. 2 indicates the suction of the induced draft fan 10 typically required under normal operating conditions in a relatively clean furnace system in relation to the furnace or boiler load, and curve B indicates the suction required with some fouling of the system. The controls 14 will normally maintain the suction close to curves A or B, and, therefore, the damper 13 normally will be partially closed. However, if the air and flue gas flows decrease without appropriate and corresponding closure of the damper 13, then, the characteristic of the fan 10 is such that it can cause increased vacuum at the inlet of the fan 10, and cause the vacuum in the furnace chamber 1 to exceed design limits.

The values of the suction difference between curves A and C represent typical values of suction for which the furnace chamber is designed to withstand, and curve C is generally of the same shape as curve A. However, it will be noted that if the flows upstream of the inlet damper are restricted, the vacuum in the furnace chamber can quickly exceed the amount determined from curve C, the hatched area in FIG. 2 indicating fan 10 suction levels which are potentially damaging. The main object of the invention is to prevent the suction upstream of the inlet damper 13 of the fan 10 from exceeding the levels determined from the curve C, and thereby to prevent subjecting the chamber 1 to a vacuum in excess of its design limits.

Ideally, the apparatus of the invention would prevent the suction at the fan 10 from exceeding the values determined from the curve C in FIG. 2, but since the continuous variation in suction limit represented by the curve C is difficult to attain, a variation of suction limit following a curve intermediate curves B and C is more practical. For example, a variation in suction limit in accordance with curve D in FIG. 2 is satisfactory even though it does not closely follow the curve C at the lower and upper portions thereof. Also, the fact that the uppermost portion of the curve D is below the curve B is unimportant, since the boiler is not normally operated at the levels corresponding to such uppermost portion of the curve D.

The apparatus of the invention as hereinafter described can act in absence of (or during failure of) automatic combustion controls to maintain safe furnace pressure levels despite improper manual operation of fan controls (as mentioned hereinbefore), or flame out conditions (as mentioned hereinafter). The invention backs up but does not substitute for normal combustion controls, which must be in service for normal operation. The apparatus of the invention may or may not allow continued partial load operation without functioning of the normal combustion controls, but should permit shut-down without damage to the furnace chamber structure.

From flame out tests which have been conducted with a furnace system of the type illustrated in FIG. 1 in which the fuel supply was suddenly discontinued while the furnace was otherwise operating normally, it was observed that the flow rates of the gases (air and flue gas) in the furnace system varied significantly and accompanied a decrease in the furnace pressure upon flame out. In other words, both the air flow rate and the flue gas flow rate are dependent on the pressure in the furnace chamber, as well as on the settings of the fan dampers, and can be used to provide a prompt indication of furnace chamber pressure reduction. A pressure device connected to the furnace chamber 1 itself and acting on combustion controls to balance furnace pressure with the atmosphere is a customarily applied system, but such system is subject to component failure of pressure device and/or other control components downstream in the system as well as interruption of electric and/or pneumatic supply to power the control system. Furthermore, a control responsive to pressure of the flue gas, e.g., at the inlet of the fan 10, would not be satisfactory because it will be observed from FIG. 2 that the pressure at the inlet of the fan 10 varies over a substantial range under normal operating conditions and without exceeding the chamber vacuum design limits.

Such a system, but with induced draft fan setting varied by furnace pressure correction, is sometimes used, but is subject to similar failures of control components and/or power supply as described hereinbefore.

The curves shown in FIG. 3 are derived from tests performed with a furnace forming part of a 400 megawatt electricity generating installation, in which tests the fuel oil flow was stopped while the furnace was running normally. The forced draft fans and induced draft fans were de-energized immediately after the fuel oil flow was discontinued, and gradually coasted down, but all air and gas flow control dampers were locked in the positions assumed thereby during the immediately previous normal operation. The testing equipment measured, directly or indirectly, furnace pressure, air flow, flue gas flow, and induced draft fan inlet pressure. At the time that the flue flow was interrupted, the furnace was operating at a level sufficient to produce 195 megawatts of electricity.

It will be observed from FIG. 3 that the pressure within the furnace decreased sharply almost immediately after the fuel flow was discontinued and reached the minimum value in about 6 seconds, and in the particular test, the pressure decreased substantially below atmospheric pressure. It will also be observed from FIG. 3 that initially, the air flow into the furnace increased substantially and the flue gas flow decreased substantially at the same time that the furnace pressure decreased. The gas flow curves decreased with fan coast down during the interval measured, but they tend to approach each other as furnace pressure is rebalanced. The flow difference at the end of the test period is probably due to small errors in the test equipment and/or data reduction. Computer simulation of the operating characteristics of a furnace for a 600 megawatt electrical installation indicates that similar curves would be obtained for the furnace pressure, air and gas flows in a furnace system including such a furnace and subjected to similar conditions.

Figure 4:
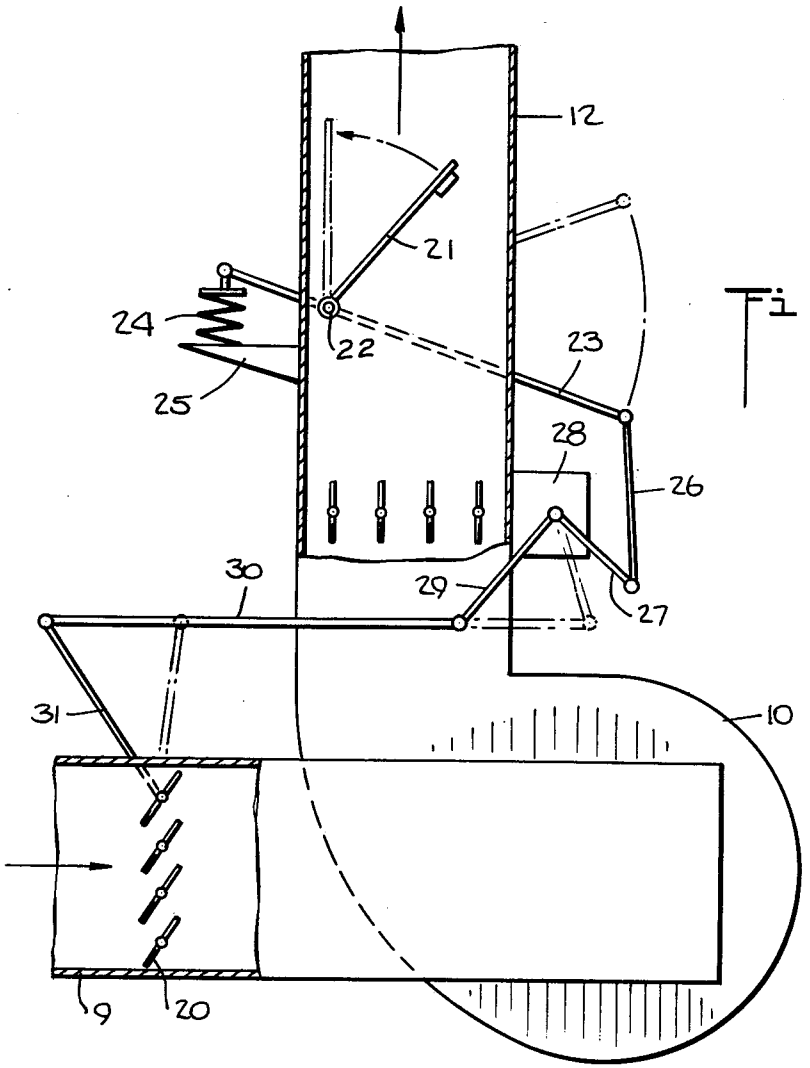
FIG. 4 is a schematic, side elevation view, partly in cross-section, illustrating control apparatus of the preferred embodiment of the invention, in which the overriding controls are entirely mechanical.

In accordance with the preferred embodiment of the invention, the change in flue gas which accompanies a change in the furnace pressure, as illustrated in FIG. 3, is used to limit the suction of the induced draft fan in a balanced draft furnace system. FIG. 4 illustrates schematically an all-mechanical control system which employs such change in the flue gas flow, or flow rate, to vary the inlet damper of an induced draft fan. In FIG. 4, a variable damper 20 is in the duct 9 at the inlet of the induced draft fan 10. Preferably, the damper 20 is the same as the damper 13 illustrated in FIG. 1, but the damper 20 may be separate from the damper 13. In the outlet duct 12, there is a plate or "flapper" 21, which is pivotally mounted so as to pivot around the point 22, and which is connected to a lever 23 so as to rotate the lever 23 around the pivot point 22. The lever 23, and hence the flapper 21, are urged in a clockwise direction, as viewed in FIG. 4, around the pivot point 22 by an adjustable, calibrated spring 24 mounted on a fixed base 25 and engaging an end portion of the lever 23.

The lever 23 is connected at one end to a link 26 which is pivotally connected to a further lever 27 which operates a cam assembly represented by the rectangle 28 and described further hereinafter. The cam assembly 28 operates a lever 29 which is connected through a linkage 30 to the damper control lever 31. When the flue gas flow through the duct 12 has its highest value, the flapper 21, the levers 23, 29 and 31 and the linkage 30 assume the positions shown in dot-dash lines in FIG. 4, but when the flue gas flow in the duct 12 decreases sufficiently, as would be the case when the flue gas flow in the duct 9 decreases substantially, the flapper 21 and its associated lever and linkages move to the positions shown in full lines in FIG. 4. The flapper 21 may, for example, move through an angle of about 20° in going from one of its two extreme positions to the other, and when it is in the position shown in full lines in FIG. 4, the damper 20 would be substantially closed so that the gas flow through the fan 10 would be reduced to about 15% of its normal value. The levers and linkages are selected so that small increments of movement of the flapper 21 will produce increasing increments of damper opening as the flapper moves from the position shown in full lines to the position shown in dot-dash lines. The spring 24 is calibrated so as to position the flapper 21 at predetermined levels for each flue gas flow rate.

Figure 5:
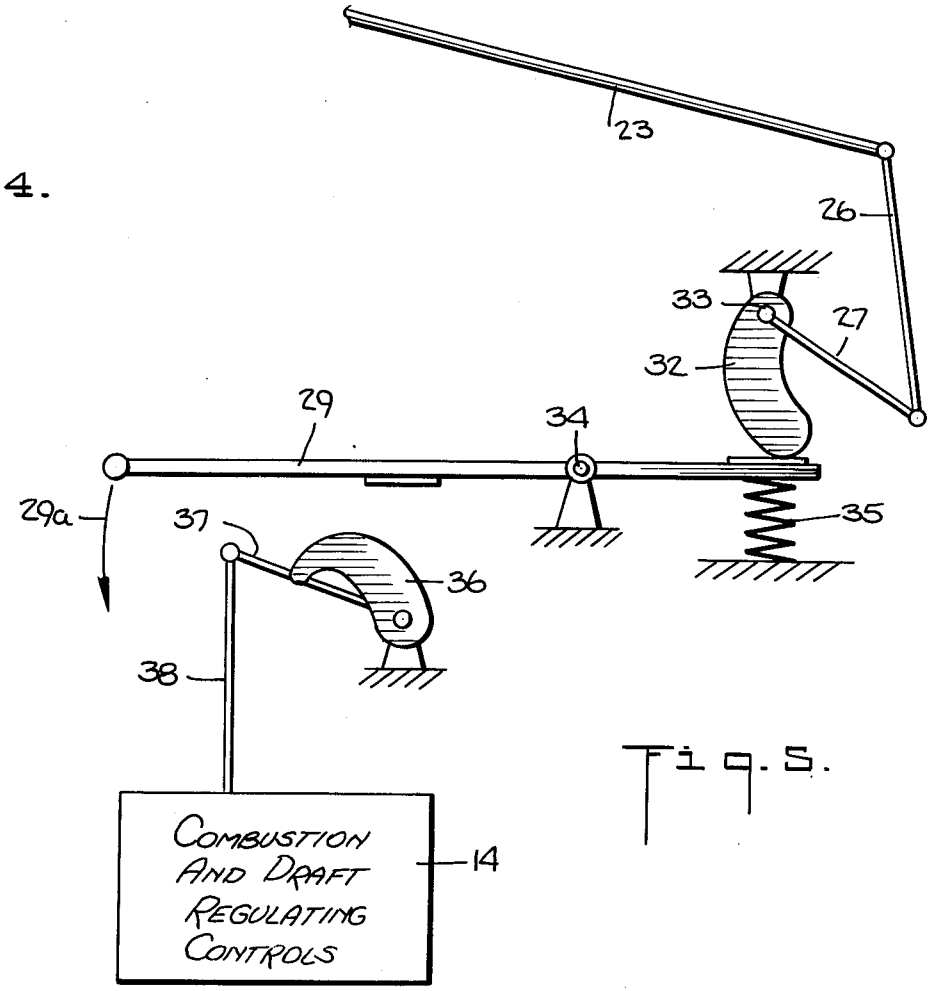
FIG. 5 is a schematic drawing of a portion of the controls illustrated in FIG. 4.

The cam assembly 28 is illustrated schematically in FIG. 5 and comprises a cam 32 driven by the lever 27 and mounted to pivot about the point 33 in accordance with the position of the lever 27. The lower end of the cam 32 bears against one end of the lever 29 which is pivotable about the point 34. The lever 29 is urged in a counter-clockwise direction about the point 34 by a spring 35, the arrow 29*a* indicating the direction in which the end of the lever 29 must move to increase the opening of the damper 20, and hence, increase flue gas flow through the fan 10.

The cam assembly 28 also comprises a pivotally mounted cam 36 which is operable by a lever 37 and a linkage 38 from the conventional combustion and draft regulating controls 14. Thus, the controls 14 will normally position the cam 36, and hence the lever 29, so that the flue gas flows (and fan inlet suction pressures) correspond to those obtained from either curve A or curve B of FIG. 2 for various furnace loads, but the movement of the lever 29 in the direction in which the damper 20 is opened will be limited by the cam 32, and hence by the position of the flapper 21. In other words, the flapper 21, in conjunction with the cam 32, will limit the damper 20 so that the flue gas flows (and fan inlet suctions) for various furnace loads will be limited to those determined from the curves D of FIG. 2, regardless of possible maloperation of controls 14, which could call for further opening of the damper 20.

For example, under normal operating conditions the controls 14 by controlling the lever 29 and the damper 20 will maintain the flue gas flows (and fan inlet suctions) at their predetermined levels for various furnace loads. However, if the amount of flue gas supplied to the inlet of the fan 10 through the duct 9 decreases sufficiently to reduce the flue gas flow in the duct 12 to permit the flapper 21 to move clockwise, as viewed in FIG. 4, then the cam 32 will be positioned so as to prevent opening of the damper 20 sufficiently to permit the vacuum in the furnace chamber 1 to exceed design limits as determined from curve C of FIG. 2. In other words, controls 14 normally maintain the flue gas flow and fan suctions at predetermined levels dependent upon the furnace system operation, and the controls of the invention modify or limit the damper 20 opening to further predetermined levels dependent upon the rate of flow of gas exteriorly of the furnace chamber 1, said further predetermined levels being higher with an increasing rate of flow of the gas exteriorly of the chamber 1.

If the controls 14 control a damper which is separate from the damper 20, then the cam 35, the lever 37 and the linkage 38 may be omitted, the controls 14 operating a separate damper, such as the damper 13, in a part of the flue gas duct system in a conventional manner.

Although the flapper 21 is schematically illustrated in FIG. 4 as being at an angle of about 30° with respect to vertical for minimum gas flow and as being vertical for maximum gas flow, studies have indicated that when the duct 12 is vertical, the flapper 21 should be nearly vertical with minimum gas flow and pivot to a position 20-30 degrees from the vertical with maximum gas flow and the gas velocities in the duct 12 upstream of the flapper 21 should be increased above customary design values to provide practical values of torque produced by the flapper 21 to operate the controls connected thereto. Such positioning of the flapper 21 and increase of gas flow velocity can readily be accomplished by means well-known in the art, such as modification of the duct design, suitably arranged internal gas flow directing plates, etc. An example of a sodisposed flapper 21 and gas flow modifying plate is described hereinafter.

Figure 6:
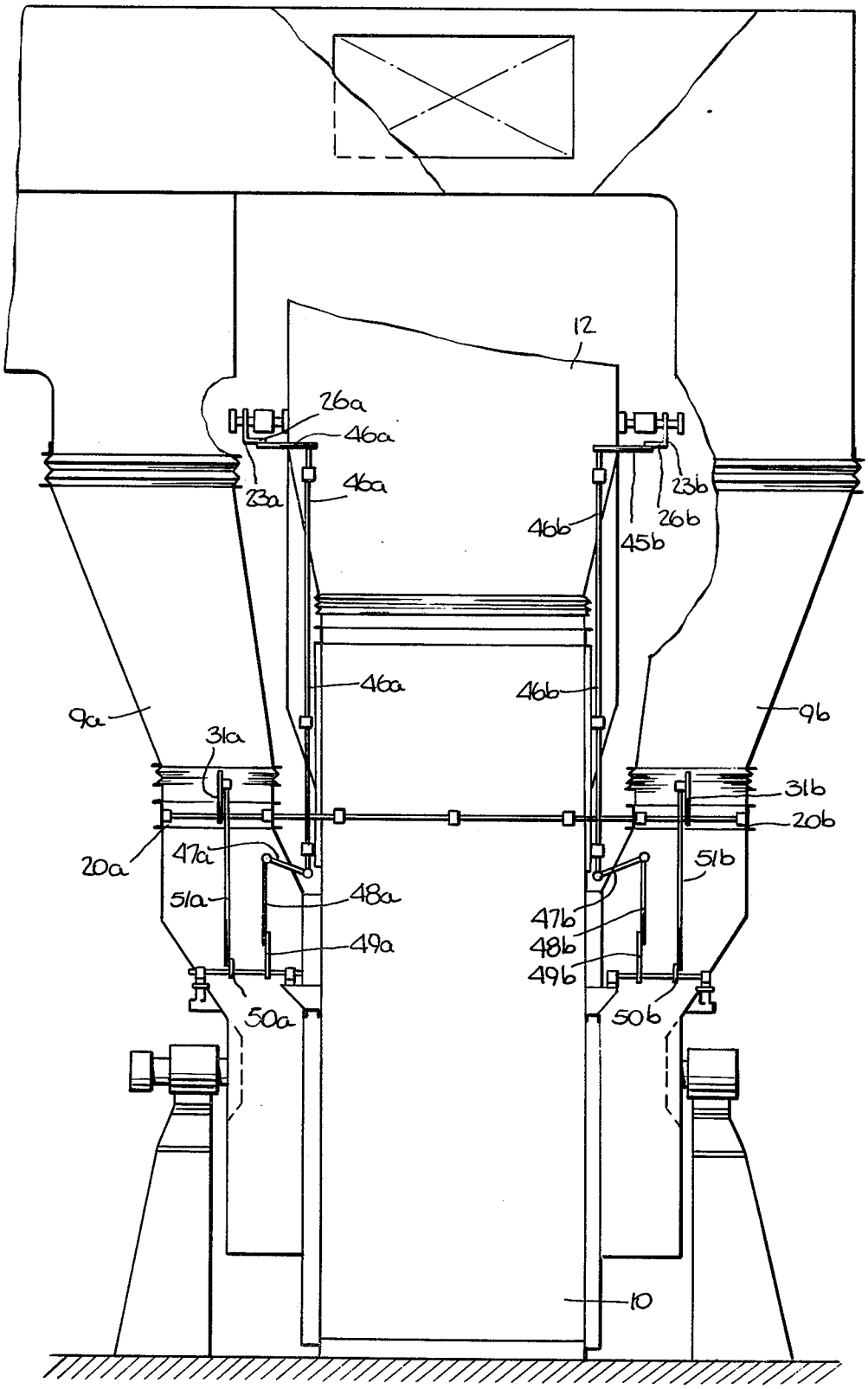

FIGS. 6 and 7 illustrate, respectively, in front elevation and fragmentary side elevation views, respectively, the application of the invention described in connection with FIGS. 4 and 5 to a typical induced draft fan 10 having a pair of inlet ducts 9*a* and 9*b*. Each of the inlet ducts 9*a* and 9*b* has an inlet damper 20*a* and 20*b*, respectively, such dampers 20*a* and 20*b* being operable by the levers 31*a* and 31*b*.

With reference to FIG. 7, the flapper 21 is secured to a shaft 39 and occupies the position shown in full lines when the flow of the flue gas through the duct 12 has its maximum value. The flapper 21 moves to the position shown in dot-dash lines in FIG. 7 when the flow of flue gas through the duct 12 decreases as explained hereinbefore. The movement of the flapper 21 is limited by a pair of stops 40 and 41. In order to direct the flue gas at the right-hand side of the flapper 21 and in order to increase the velocity of the flue gas flow in the duct 12, a plate 42, extending from the outlet of the fan 10 to the shaft 39, may be provided, such plate 42 extending across the width of the duct 12.

The lever 23*a* is also secured to the shaft 39 and is urged in the clockwise direction by a hanger 43 comprising a spring 44 which corresponds to the spring 24 in FIG. 4. When the shaft 39 is rotated by the flapper 21, the lever 23*a* through the linkage 26*a* and the lever 45*a* rotates a shaft 46*a* causing movement of a lever 47*a* secured thereto and through linkage 48*a*, levers 49*a* and 50*a* and linkage 51*a*, causing movement of the lever 31*a* which controls the opening and closing of the inlet damper 20*a*. The sizes and positions of such levers and linkages may be selected so as to provide the desired relationship between the position of the flapper 21 and the opening or closing of the damper 20*a*.

The shaft 39 may also operate a corresponding set of levers, linkages and shaft on the opposite side of the outlet duct 12, such levers, linkages and shafts being designated by corresponding reference numerals with the suffix "*b*", to control an inlet damper 20*b* in the inlet duct 9*b*. Alternatively, interconnection of dampers 20*a* and 20*b* could allow elimination of the levers, etc. designated by the suffix "*b*".

Thus, when the flapper 21 is moved to the position shown in full lines in FIG. 7, by the flue gas flow, the inlet dampers 20*a* and 20*b* are opened toward the positions which permit the flue gas flow indicated by the upper portions of the curve D in FIG. 2, whereas when the flue gas flow reduces sufficiently to permit the flapper 21 to assume the position shown in dot-dash lines in FIG. 7, the inlet dampers 20*a* and 20*b* are closed to the extent required to reduce the flue gas flow to the values indicated by the lower portion of curve D in FIG. 2. It will be noted from the description given hereinbefore that the inlet dampers 20*a* and 20*b* may close to the extent necessary to reduce the flue gas flow to about 15% of its maximum value which, generally, is the normal leakage of a fully closed damper and, therefore, when the flue gas flow to the inlet of the fan 10, i.e., the flue gas flowing in the ducts 9*a* and 9*b*, increases, the flapper 21 will move from the position shown in dot-dash lines in FIG. 7 toward the position shown in full lines in FIG. 7. The fan 10 is further controlled (trimmed) by the normal combustion and draft regulating controls 14, acting on another damper as hereinafter described.

In the embodiment shown in FIGS. and 7, the combustion and draft regulating controls 14 control a separate damper 55 at the outlet of the fan 10, and hence, in the duct 12. In other words, in such embodiment, the conventional draft regulating controls operate an outlet damper 55 rather than an inlet damper as illustrated in FIG. 1, but it will be understood that the controls 14 may operate the dampers 20*a* and 20*b* (via the cam mechanism such as shown in FIG. 5 as described hereinbefore), or may operate a separate inlet damper 13.

In some cases, it is desirable that the furnace, etc. be subjected to the natural draft of the stack when the induced draft fan is de-energized. It will be noted that when the furnace system includes the apparatus of the invention, the damper controlled by such apparatus is substantially closed when the flue gas flow caused by the induced draft fan 10 is substantially reduced or the fan 10 is de-energized, whereas in the conventional systems, the controls are such that the dampers may be wide open when the induced draft fan 10 is inoperative. In those cases where it is desirable that the furnace system be subjected to the natural draft of the stack 11 when the fan 10 is de-energized, the induced draft fan system may be provided with a by-pass duct 56 extending between the ducts 9*a* and 9*b* and the outlet duct 12. The by-pass duct 56 is controlled by a damper 57 which, in turn, is controlled by a drive 58 of a known type which may be operated to open the damper 57 when the fan 10 is de-energized. Alternatively, the duct 56 and the damper 57 may be omitted, and the drive 58 may be connected to the flapper 21 so as to move it to the position shown in full lines in FIG. 7 when the fan 10 is de-energized. Alternatively, a drive similar to the drive 58 can be applied so as to prevent the action of, or by-pass, the spring-hanger 43–44 when the fan motor is de-energized, allowing opening of the dampers 20*a* and 20*b*.

In the embodiments described hereinbefore, the apparatus of the invention controls one or more dampers at the inlet of the induced draft fan 10. The variation in pressure in the furnace chamber 1 during flame out may be further reduced, or the action of the apparatus of the invention in connection with the induced draft fan 10, may be assisted by similarly equipping the forced draft fan 2 at the input of the furnace chamber 1. Such equipping of the fan 2 will also act so as to prevent excessive positive chamber pressure. In other words, the forced draft fan 2 may be equipped with the flapper and damper control apparatus associated with the induced draft fan 10, and heretofore described, so that the inlet damper 5, or a similar damper of the forced draft fan 2 is controlled by a flapper 21 in the outlet duct 3 of the forced draft fan 2, the operation of such apparatus in conjunction with the forced draft fan 2 being as described hereinbefore in connection with the induced draft fan 10, except for the fact that the flapper 21 is controlled by the gas flow in the duct 3 rather than the gas flow in the duct 12. Thus, with reference to FIGS. 1, 3 and 4, it will be observed that when the pressure in the furnace chamber 1 reduces, the air flow into the furnace chamber 1 increases, which would cause movement of the flapper 21 in a direction which further opens the inlet damper 5 and thereby further increases the air flow into the furnace chamber 1 and aids in preventing an excessive vacuum in the furnace chamber 1.

Such operation of the so-equipped fan 2 results if the flapper 21 is separately connected to the forced draft fan inlet damper without a cam assembly 28 driven by the combustion controls 14 or if the combustion controls 14 act to open the cam 36 (FIG. 5) fully upon fuel trip which allows the flapper 21 to control the forced draft fan inlet damper.

Since furnace chamber pressure returns toward its normal value after a fuel trip, the flapper 21 will move in the direction which will close the forced draft fan inlet damper, and will thereby avoid pressurizing the furnace chamber to an undesirable high value during the transient.

In addition, a flapper 21 installed in the discharge duct of a forced draft fan will always act to limit the fan pressure developed so as to avoid pressurizing the furnace chamber 1 to an undesirable value, with or without the scheme that includes the cam assembly 28 (FIG. 5).

Also, in all of the embodiments described hereinbefore, the apparatus of the invention controls dampers in the furnace system rather than other known devices which have also been used to control the gas flow in the system. In the embodiments illustrated in FIGS. 8–11, the flue gas flow rate is indirectly used to limit the speed of the induced draft fan 10 to thereby limit the suction potential provided by the induced draft fan 10.

FIG. 8 illustrates an induced draft fan 10 driven by a motor 60 through a known type of hydraulic coupling 61. Hydraulic fluid is supplied to the coupling 61 through a line 62 connected to a pump 63 through a cooling device 64. The speed of rotation of the fan 10 depends upon the position of a control lever 65 on the hydraulic coupling 61 and the power requirements of the fan, so that the fan 10 may be driven at substantially any speed below that of the motor 60.

The position of the lever 65 is controlled by a pivotally mounted lever 66 biased at one end by a spring 67 and positioned at its opposite end by a piston and cylinder assembly 68. The piston and cylinder assembly 68 is hydraulically actuated by the hydraulic fluid supplied through the lines 69 and 70 and the hydraulic relays 71 and 72, the lines 69 being connected to the line 62 through a pressure reducing valve 73.

A conventional venturi type device 74, or a similar device, which measures the velocity of the flue gas flow in the duct 9, is connected through a pair of lines 75 and 76 to a known type of differential pressure device including a hydraulic relay 71 which is actuated in accordance with the differences in pressure indicated by the signals on the lines 75 and 76. In other words, when the velocity of the flue gas in the duct 9 increases, the hydraulic relay 71 opens further to increase the pressure of the fluid supplied through the hydraulic relay 72 to the piston and cylinder assembly 68, thereby actuating the lever 65 so as to permit the speed of the fan 10 to increase to the extent determined by the hydraulic relay 72. Conversely, when the velocity of the flue gas in the duct 9 decreases, the hydraulic relay 71 moves towards its closed position thereby limiting the speed of the fan 10 to a lower value.

Figure 12:
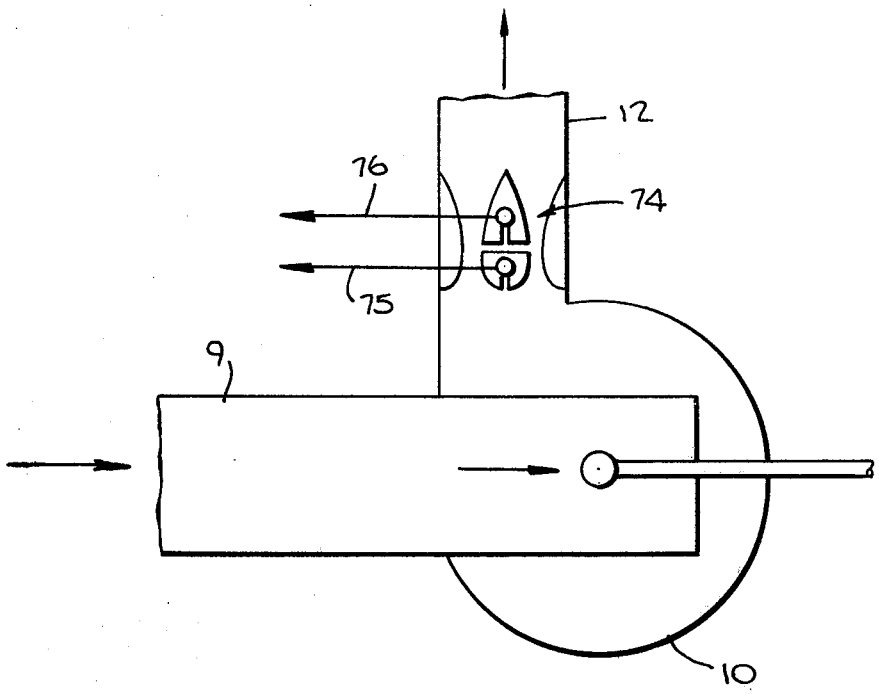
FIG. 12 is a schematic diagram showing an alternate location of the venturi device shown in FIGS. 8 and 10.

Instead of locating the venturi type device 74 in the duct 9, it may be located in the outlet duct 12 as indicated in FIG. 12.

The hydraulic relay 72 is controlled by the conventional combustion control 14 so as to maintain the speed of rotation of the fan 10 at the speed required to provide flue gas flow in the system at the values indicated by the curves A or B in FIG. 2. Accordingly, the speed of the fan 10 will normally be determined by the combustion controls 14 and the hydraulic relay 72, but the hydraulic relay 71 will control the speed of the fan 10 so that the suction will not exceed the values determined from curve D in FIG. 2.

Figure 9:
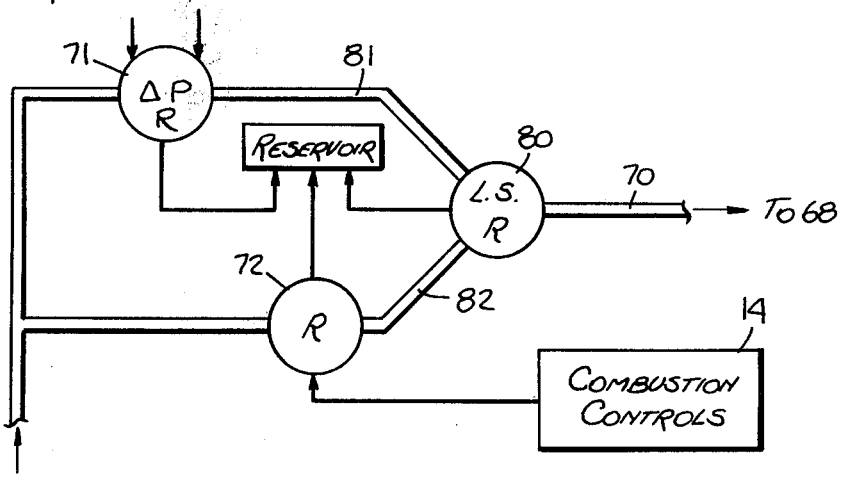
FIG. 9 is a schematic diagram showing an alternate arrangement of the controls illustrated in FIG. 8.

FIG. 9 illustrates an alternative arrangement for the hydraulic relays which control the piston and cylinder assembly 68, and hence, the speed of the fan 10. In FIG. 9, there is a further hydraulic relay 80 which controls the pressure of the fluid in the line 70 in accordance with the lower of the two pressures in the lines 81 and 82 connecting the hydraulic relays 71 and 72 to the hydraulic relay 80. In other words, the pressure of the fluid in the line 70 is determined by whichever of the lines 81 or 82 has the lower pressure. Thus, the pressure in the line 70 will normally be determined by the hydraulic relay 72, but when the flue gas velocity decreases below the level determined from curve D, the fluid pressure in the line 70 will be determined by the hydraulic relay 71. Accordingly, the speed of the fan 10 will normally be controlled by the combustion controls 14, but in the event of an abnormal decrease in the flue gas velocity in the duct 9, the speed of the fan 10 will be controlled by the hydraulic relay 71.

Figure 10:
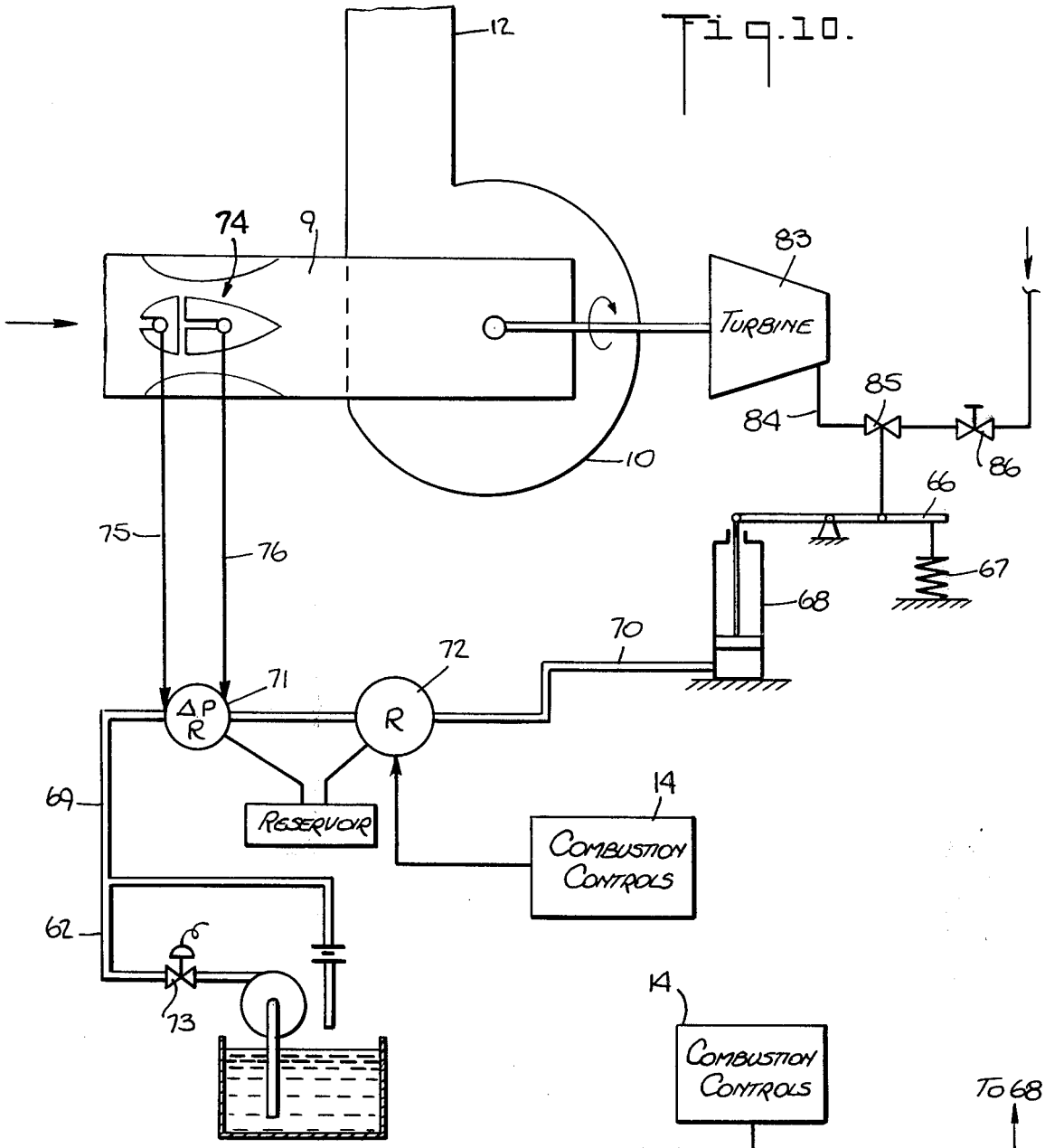
FIG. 10 is a schematic diagram illustrating a further alternative embodiment of the invention in which the speed of an induced draft fan is varied for control thereof.
Figure 11:
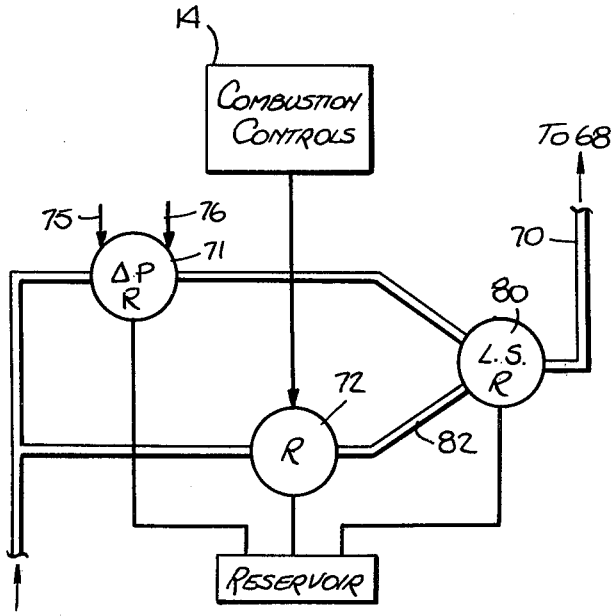
FIG. 11 is a schematic diagram showing an alternate arrangement of the controls illustrated in FIG. 10.

FIGS. 10 and 11 illustrate schematically control systems similar to those illustrated in FIGS. 8 and 9, except for the fact that the speed of the fan 10 in FIGS. 10 and 11 is controlled by the control of the speed of a driving turbine 83. In the embodiment illustrated in FIG. 10, the fan 10 is driven by the turbine 83 which is fluid driven, such as by steam supplied thereto through a line 84 from a source of such fluid (not shown), such as the steam normally generated in the installation including the furnace system. The fluid is supplied to the line 84 through a control valve 85 and a trip valve 86. The position of the valve 85 is controlled by the piston and cylinder assembly 68, the lever 66 and the spring 67 in the manner described in connection with FIG. 8. Accordingly, the speed of the turbine 83, and hence the speed of the fan 10, is normally controlled by the combustion controls 14 through the hydraulic relay 72, but in the event that the flue gas velocity in the duct 9 decreases below predetermined values for various furnace loads, the speed of the turbine 83, and hence the speed of the fan 10, is controlled by the hydraulic relay 71.

FIG. 11 illustrates an alternative arrangement of the controls of FIG. 10 and is similar to the alternative arrangement of FIG. 9. In the arrangement of FIG. 11, the hydraulic relay 80 normally controls the pressure in the line 70, and hence the speed of the turbine 83 and the fan 10, in accordance with the pressure of the hydraulic fluid in the line 82, which pressure is controlled by the combustion controls 14 through the hydraulic relay 72. However, when the flue gas velocity in the duct 9 decreases below predetermined values, depending upon the furnace load, the hydraulic relay 80, and hence the pressure in the line 70, is controlled by the hydraulic relay 71 which, in turn, is controlled by the venturi type device 74.

As described hereinbefore, the controls described in connection with FIGS. 8–11 may be similarly employed to control the speed of the forced draft fan 2 in the same manner that such controls control the speed of the induced draft fan 10.

Although preferred embodiments of the present invention have been described and illustrated, it will be understood by those skilled in the art that various modifications may be made without departing from the principles of the invention.

What is claimed is:

1. In a furnace system having a combustion chamber, fan means and duct means connected to said chamber for moving gas along a path extending from exteriorly of and into said chamber, through said chamber and then outwardly from and away from said chamber, said fan means including at least one fan having an inlet and an outlet and the gas pressure internally of said chamber being at least partially dependent upon the level of flow of the gas which is supplied to and removed from said chamber, said chamber being subject to damage when said gas pressure internally of said chamber reaches a predetermined value, gas flow modifying means in said path for modifying the flow of gas through said chamber and control means comprising measuring means in said path and connected to at least part of said gas flow modifying means for normally maintaining the flow of said gas at predetermined levels required for normal operation of said system, the combination therewith of gas flow measuring means in the path of said gas outside said chamber and adjacent said fan, said last-mentioned measuring means being responsive to changes in the flow of said gas at one of said inlet and said outlet, and gas flow limiting means interconnecting said last-mentioned measuring means and at least part of said gas flow modifying means for changing the flow of said gas from said predetermined levels to further predetermined levels which are dependent upon the rate of flow of said gas exteriorly of said chamber, said further predetermined levels being higher with an increasing rate of flow of said gas exteriorly of said chamber and lower with a decreasing rate of flow of said last-mentioned gas but being less than the gas flow level which will cause the gas pressure internally of said chamber to reach said predetermined value.

2. A furnace system as set forth in claim 1, wherein said fan is an induced draft fan connected to said chamber for removing said gas therefrom.

3. A furnace system as set forth in claim 2, wherein said gas flow modifying means comprises means for varying the speed of said induced draft fan.

4. A furnace system as set forth in claim 3, wherein said duct means comprises an inlet duct and an outlet duct connected to said induced draft fan and wherein said measuring means is in one of said inlet duct and said outlet duct.

5. A furnace system as set forth in claim 4, wherein said measuring means comprises means for measuring the velocity of the flow of said gas.

6. In a furnace system having a combustion chamber, fan means and duct means connected to said chamber for moving gas along a path extending from exteriorly of and into said chamber, through said chamber and then outwardly from and away from said chamber, said fan means comprising an induced draft fan and said duct means comprising an inlet duct interconnecting said fan with said chamber for removing said gas therefrom and an outlet duct connected to said fan, gas flow modifying means in said path for modifying the flow of gas through said chamber and control means comprising measuring means in said path and connected to at least part of said gas flow modifying means for normally maintaining the flow of said gas at predetermined levels, the combination therewith of gas flow measuring means in the path of said gas outside said chamber and responsive to changes in the flow of said gas, limiting means interconnecting said last-mentioned measuring means and at least part of said gas flow modifying means for changing the flow of said gas from said predetermined levels to further predetermined levels dependent upon the rate of flow of said gas exteriorly of said chamber, said further predetermined levels being higher with an increasing rate of flow of said gas exteriorly of said chamber, said gas flow modifying means comprising a variable damper in said inlet duct for varying the duct passageway size at said damper, said measuring means comprising a flapper pivotally mounted in said outlet duct adjacent to said fan and variable in position in accordance with the rate of flow of the gas in said outlet duct and said interconnecting means comprising mechanical means for varying said passageway size dependent upon the position of said flapper.

7. A furnace system as set forth in claim 6, wherein said mechanical means comprises a cam, first levers interconnecting said flapper and said cam for rotating said cam under control of said flapper and second levers interconnecting said cam and said damper for positioning said damper in accordance with the position of said cam.

8. A furnace system as set forth in claim 7, further comprising a second cam engageable with one of said second levers for positioning said damper in accordance with the position of said second cam and means interconnecting said control means and said second cam for positioning said second cam and hence, said damper, under control of said control means.

9. A furnace system as set forth in claim 6, wherein said mechanical means comprises a plurality of levers and linkages interconnecting said flapper and said damper.

10. A furnace system as set forth in claim 2, wherein said fan means also comprises a forced draft fan having an inlet and an outlet and said duct means comprises an outlet duct interconnecting said outlet of said forced draft fan and said chamber for supplying air to the latter and further comprising measuring means in said outlet duct and responsive to changes in the rate of flow of the air in said outlet duct, air flow modifying means at said inlet of said forced draft fan for varying the flow of air through said forced draft fan and means interconnecting said last-mentioned measuring means and said air flow modifying means for increasing the air flow through said forced draft fan when the air flow in said outlet duct increases.

11. A furnace system as set forth in claim 2, wherein said fan has an inlet and an outlet and rotatable gas impelling means between said inlet and said outlet for drawing gas into said inlet and expelling gas out of said outlet and thereby causing gas to flow through said fan, said inlet being connected to said chamber, and wherein said gas flow modifying means comprises control means connected to said gas impelling means for controlling the rate at which said impelling means causes gas to flow through said fan, said last-mentioned control means being connected to said last-mentioned measuring means for varying the flow rate of gas through said fan.

* * * * *